US008479514B2

(12) United States Patent
Mayr

(10) Patent No.: US 8,479,514 B2
(45) Date of Patent: Jul. 9, 2013

(54) METHOD AND DEVICE FOR GENERATING COMPRESSED AIR AND FOR BLOWING IT INTO AN INTERNAL COMBUSTION ENGINE

(75) Inventor: Mathias Mayr, Germering (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 0 days.

(21) Appl. No.: 12/854,709

(22) Filed: Aug. 11, 2010

(65) Prior Publication Data

US 2011/0041496 A1 Feb. 24, 2011

Related U.S. Application Data

(63) Continuation of application No. PCT/EP2009/000938, filed on Feb. 11, 2009.

(30) Foreign Application Priority Data

Feb. 12, 2008 (DE) ..... 10 2008 008 723

(51) Int. Cl.

| | |
|---|---|
| ***F02B 33/44*** | (2006.01) |
| ***F02B 37/00*** | (2006.01) |
| ***F02B 37/04*** | (2006.01) |
| ***F02B 33/00*** | (2006.01) |
| ***F02B 33/22*** | (2006.01) |
| ***F02B 41/06*** | (2006.01) |

(52) U.S. Cl.

USPC ..... 60/611; 60/598; 123/70 R; 123/68

(58) Field of Classification Search

USPC .. 60/598, 611; 123/68, 70 R, 559.1; 417/237, 417/34; 477/115

IPC ..... F02B 37/04,21/00, 37/00

See application file for complete search history.

(56) References Cited

U.S. PATENT DOCUMENTS 3,958,900 A 5/1976 Ueno
3,963,379 A 6/1976 Ueno (Continued)

FOREIGN PATENT DOCUMENTS

DE 30 41 674 A1 6/1982
DE 198 49 914 C1 11/1999

(Continued)

OTHER PUBLICATIONS

German Office Action dated Aug. 14, 2008 including English-language translation (Eight (8) pages).

(Continued)

*Primary Examiner* — Thai Ba Trieu
(74) *Attorney, Agent, or Firm* — Crowell & Moring LLP

(57) ABSTRACT

The invention relates to a method for producing compressed air and for injecting the same in an internal combustion engine, in particular a diesel motor, comprising an exhaust turbocharger. The method has the following steps: determination of operating parameters of the internal combustion engine to identify operating states of the internal combustion engine; production of compressed air by the internal combustion engine using the determined operating parameter in an operating state without combustion and storage of the produced compressed air; and injection of the stored compressed air into the combustion engine using the determined operating parameter in an operating state with combustion of the internal combustion engine in order to increase the pressure in an induction cycle. The invention also relates to a corresponding device.

8 Claims, 1 Drawing Sheet

U.S. PATENT DOCUMENTS

| | | | | |
|---|---|---|---|---|
| 4,478,304 | A * | 10/1984 | Delano | 180/165 |
| 4,565,167 | A * | 1/1986 | Bryant | 123/70 R |
| 5,103,645 | A * | 4/1992 | Haring | 123/68 |
| 5,529,549 | A * | 6/1996 | Moyer | 477/189 |
| 5,997,259 | A * | 12/1999 | Marshall et al. | 417/364 |
| 6,328,003 | B1 | 12/2001 | Gaertner et al. | |
| 6,695,591 | B2 * | 2/2004 | Grimmer et al. | 417/203 |
| 6,939,517 | B2 * | 9/2005 | Ooe et al. | 422/172 |
| 7,007,639 | B1 * | 3/2006 | Luttgeharm | 123/68 |
| 7,467,608 | B2 * | 12/2008 | Luttgeharm | 123/68 |
| 7,665,302 | B2 | 2/2010 | Nemeth et al. | |
| 7,685,819 | B2 * | 3/2010 | Vetrovec | 60/611 |
| 7,905,221 | B2 * | 3/2011 | Salminen | 123/70 R |
| 8,051,811 | B2 * | 11/2011 | Phillips | 123/70 R |
| 2001/0002379 | A1 | 5/2001 | Schechter | |
| 2002/0031454 | A1 * | 3/2002 | Ooe et al. | 422/172 |
| 2008/0006251 | A1 | 1/2008 | Schmid et al. | |
| 2008/0072595 | A1 | 3/2008 | Nemeth et al. | |
| 2010/0086414 | A1 * | 4/2010 | Tai | 417/34 |
| 2010/0095927 | A1 * | 4/2010 | Salminen | 123/254 |
| 2010/0192878 | A1 * | 8/2010 | Mustafa | 123/559.1 |
| 2011/0023820 | A1 * | 2/2011 | Donitz et al. | 123/316 |
| 2011/0253098 | A1 * | 10/2011 | Pursifull et al. | 123/559.1 |
| 2011/0253111 | A1 * | 10/2011 | Pursifull | 123/559.1 |

FOREIGN PATENT DOCUMENTS

| | | | |
|---|---|---|---|
| DE | 10 2005 001 757 | A1 | 7/2006 |
| DE | 10 2006 008 783 | A1 | 9/2006 |
| DE | 10 2006 008 785 | A1 | 3/2007 |
| EP | 531277 | A2 * | 3/1993 |
| EP | 1956213 | A1 * | 8/2008 |
| FR | 2 831 605 | A1 | 5/2003 |
| WO | WO 2006/074497 | A2 | 7/2006 |
| WO | WO 2008/088554 | A1 | 7/2008 |

OTHER PUBLICATIONS

International Search Report dated Apr. 6, 2009 including English-language translation (Four (4) pages).
German Examination Report mailed Aug. 21, 2012.

* cited by examiner

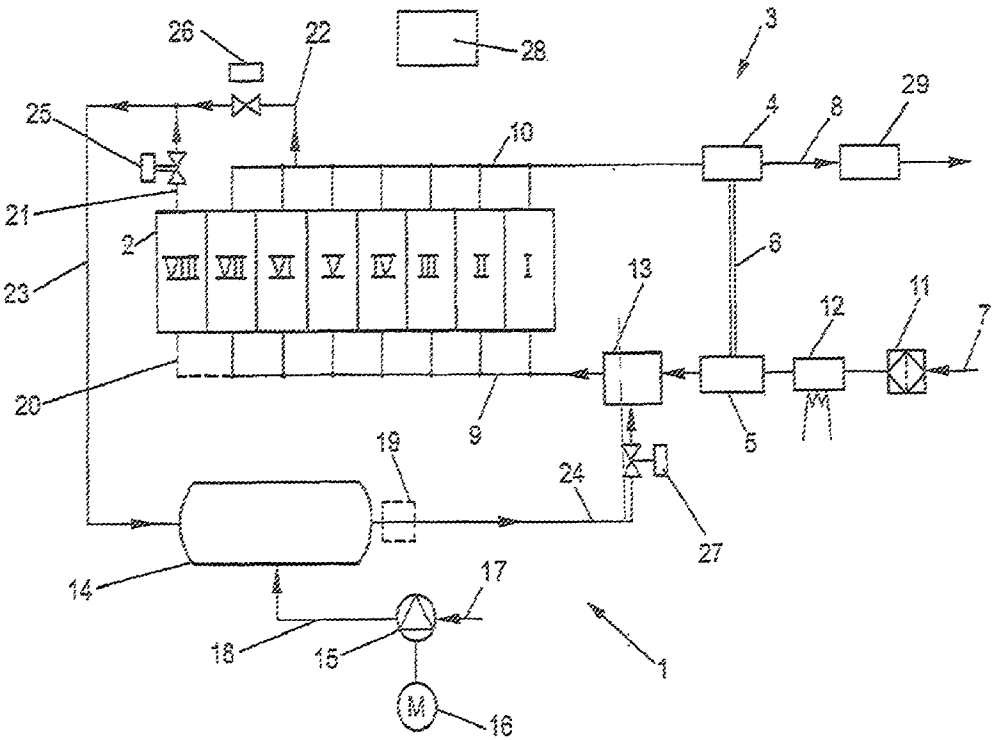
1
2
3
4
5
6
7
8
9
10
11
12
13
14
15
16
17
18
19
20
21
22
23
24
25
26
27
28
29
I
II
III
IV
V
VI
VII
VIII
M

METHOD AND DEVICE FOR GENERATING COMPRESSED AIR AND FOR BLOWING IT INTO AN INTERNAL COMBUSTION ENGINE

This application is a continuation of PCT International Application No. PCT/EP2009/000938, filed Feb. 11, 2009, which claims priority under 35 U.S.C. §119 to German Patent Application No. DE 10 2008 008 723.8, filed Feb. 12, 2008, the entire disclosures of which are herein expressly incorporated by reference.

BACKGROUND AND SUMMARY OF THE INVENTION

The invention relates to a method and a device for generating compressed air and blowing it into an internal combustion engine, in particular a diesel engine, having an exhaust gas turbocharger.

Such internal combustion engines, for example piston engines such as diesel engines, with an exhaust gas turbocharger have, for example, an operating state during acceleration which is referred to as "turbo lag". Here, when the throttle is opened the internal combustion engine does not react with an increase in the rotational speed until after a certain delay time during which exhaust gas energy is not available, i.e., is sufficient exhaust gas pressure is not available to drive the exhaust gas turbocharger, and therefore no compressed fresh gas is available. In order to get around this "turbo lag", solutions have been proposed which are described in laid-open German patent applications DE 10 2006 008 783 A1 and DE 10 2006 785 A1. In said documents, compressed air, for example from a compressed air accumulator, is introduced into the intake line of the internal combustion engine in a controlled fashion in order to cover the fresh gas demand of the internal combustion engine when said demand is increased. This is carried out by a component which is arranged in the intake line between the compressor of the turbocharger and the intake manifold and which has a compressed air port and a controlled flap. When compressed air is fed in, the controlled flap is closed, with the result that the compressed air does not flow into the compressor of the exhaust gas turbocharger but rather flows directed into the intake line.

In engines with exhaust gas circulation, it is in addition desirable that sufficient fresh air is still fed to the engine in addition to the exhaust gas in order to avoid putting the dynamics of the engine at risk. Here too, the exhaust gas turbocharger is capable of feeding sufficient fresh air only if it is operated by a sufficient flow of exhaust gas. The active blowing in of air is also capable of contributing significantly to improving the engine dynamics here.

The compressed air which is necessary for the blowing in of air can be made available by a compressed air brake system in vehicles with such a system, for example in a separate compressed air vessel which is separate from the brake system.

The blowing in of air in the case of vehicles which do not carry any compressed air with them is problematic.

The engine itself can be configured as a compressed air generator, which is the state of the art today. Systems are known which selectively do not supply certain cylinders with fuel on a temporary basis and which carry away the air which has been compressed by the piston in this way into a reservoir vessel.

The object of the present invention is therefore to make available a method and a device for generating compressed air and blowing it into an internal combustion engine in which the above disadvantages are eliminated or significantly reduced and further advantages are obtained.

A basic idea of the invention is to make a system combination which is generated during operation of the internal combustion engine without combustion and using this compressed air, which is then stored and used again in a subsequent combustion mode for a more rapid increase in pressure in an intake cycle.

This advantageously ensures that an over-run fuel cutoff mode of a motor vehicle is utilized to thereby generate compressed air. This is particularly advantageous when a compressed air brake system with all its components is not present.

In the over-run fuel cutoff mode, which can be clearly determined from the operating parameters of sensors which are frequently already present in the vehicle or an engine controller which is present, compressed air is generated by at least one cylinder of the internal combustion engine to which fuel is not fed in the operating state without combustion. This can only be a single cylinder which is provided, for example, particularly for generating pressure and which can be added to the circuit as an additional cylinder only when the internal combustion engine is subjected to high loading. However, it is also possible for all the cylinders to jointly compress only intake air without fuel, and said air can then be extracted from a common exhaust line via a controlled valve, in this case, the exhaust line can be constricted in cross section by suitable means, for example a throttle valve (in the FIGURE, valve 29 in the flow path of exhaust gas outlet 8) such as an engine brake, in order to achieve a greater air quantity yield.

The valve is controlled by a control unit which interacts with the engine controller or sensors in order to open this extraction valve at the correct time, which extraction valve then, when in the opened state, produces a connection to a compressed air vessel in which the extracted, generated compressed air is stored. The valve can also be connected only when there is one cylinder and/or with all the cylinders, in order to obtain a large possibility of variation in the quantities of generated and stored compressed air.

The stored air is available for the controlled blowing into the next acceleration process of the internal combustion engine. As long as all the cylinders of the internal combustion engine are used to generate compressed air, even brief over-run fuel cutoff phases of the vehicle in which the internal combustion engine is installed may already be sufficient to generate sufficient quantities of compressed air for the blowing-in process.

In a repeating operating mode, that is to say over-run fuel cutoff phases are followed by acceleration phases, and vice versa, the storage of the compressed air is necessary only for a brief time. Here, it is not required of the compressed air generating means that it must always make available sufficient compressed air, as is the case, for example, in a compressed air brake system. Specifically, the storage of the compressed air for the blowing in of air does not have to be made as complex for only a brief storage time as the storage of compressed air in a compressed air brake system. In particular, it is possible to dispense with the drying of air as long as the condensation water which is produced is discharged from the reservoir vessel, for example by a water separator. The internal combustion engine can advantageously basically be supplied with non-dried air.

In a further embodiment, the gas feed device is a fresh gas line section of a device for supplying fresh air for the controlled blowing in of compressed air. Here, a combination of the advantages of the blowing in of compressed air in terms of what is referred to as "turbo lag" as well as those of improved exhaust gas circulation are obtained.

Other objects, advantages and novel features of the present invention will become apparent from the following detailed description when considered in conjunction with the accompanying drawings.

BRIEF DESCRIPTION OF THE DRAWINGS

The FIGURE schematically illustrates an embodiment of the present invention.

DETAILED DESCRIPTION

The FIGURE is a schematic illustration of an internal combustion engine 2 with an exhaust gas turbocharger 3 and an inventive device 1 for generating compressed air and blowing it in.

In the illustrated example, the internal combustion engine 2 is a diesel engine with eight cylinders I to VIII, an intake line 9 and an exhaust line 10. An air inlet 7 is connected via an air filter 11 to an intake air preheating means 12 which is connected to a compressor 5 of the exhaust gas turbocharger 3. This is adjoined by a gas feed device 13 which opens into the intake line 9. The compressor 5 of the exhaust gas turbocharger 3 is coupled to an exhaust gas turbine 4 of the exhaust gas turbocharger 3 via a coupling 6, for example a shaft. The exhaust gas turbine 4 is arranged in the exhaust line 10 upstream of an exhaust gas outlet 8 for the exhaust gas of the internal combustion engine 2, and is driven by an exhaust gas flow.

The gas feed device 13 has here a port with a blowing-in valve 27 for feeding in stored compressed air from a compressed air vessel 14 via a blowing-in line 24. The compressed air vessel 14 is connected to the blowing-in line 24 via a water separator 19 for separating condensation water from the compressed air.

The compressed air vessel 14 is fed via a collecting pressure line 23 which communicates here with an outlet of a pressure line valve 25 and an outlet of a branching line valve 26. The pressure line valve 25 is connected via a pressure line 21 to an outlet of the cylinder VIII of the internal combustion engine 2, while the branching line valve 26 communicates via a branching pressure line 22 with the exhaust line of the cylinders I to VII. The cylinder VIII is embodied here as an additional cylinder which is connected via a suction line 20 to the intake line 9 and can only be provided for generating compressed air. However, in the event of particular loading of the internal combustion engine 2 it can also be connected into the circuit as a working cylinder in addition to the other cylinders I to VII, and it can be provided with fuel. In this case, its outlet is also connected to the exhaust line 10 (not shown here), as can easily be imagined.

An engine control device (not shown) is connected to injection systems of the cylinders I to VIII. The engine control device controls the internal combustion engine in a known fashion and is not explained further.

The gas feed device 13 is in this example a fresh gas line section such as is described in German patent documents DE 10 2006 008 783 A1 and DE 10 2006 008 785 A1 in conjunction with an associated compressed air generating means. A detailed explanation is therefore not given here.

The function of this device 1 will now be described.

A control unit 28 acquires, through comparison with previously defined threshold values, the operating states of the internal combustion engine 2 from data values of the engine control device or from a bus device, for example. If an overrun fuel cutoff mode is present, fuel is not fed into the cylinders I to VIII and now they suck in and compress only air from the intake line 9. In the expulsion cycle, the branching line valve 26 and also the pressure line valve 25 are opened by the control unit 28 and the compressed air which is generated is fed into the compressed air vessel 14 via the collecting pressure line 23. In the other cycles of the internal combustion engine 2, the valves 25 and 26 remain closed. The compressed air vessel 14 can be provided, in a conventional way which is not illustrated in more detail, with a non-return valve which prevents the compressed air stored in it from being able to escape.

At the start of an acceleration state of the internal combustion engine 2, which is acquired by means of the connection of the control unit 28 which is explained above, said control unit 28 opens the blowing-in valve 27 at a suitable time in the intake cycle of the cylinders I to VIII in order therefore to bring about an increase in pressure through the stored compressed air from the compressed air vessel 14.

The invention is not restricted to the exemplary embodiments described above. For example, it can be modified within the scope of the appended claims.

It is therefore conceivable, for example, that the compressed air vessel 14 is fed by a second compressed air generating source which is equipped here in the form of a compressor 15 with a drive 16 which can, for example, be an electric motor. The compressor 15 is connected by a compressor suction line 17 to the atmosphere. Its pressure side is connected to the compressed air vessel 14 via a compressor pressure line 18 and a non-return valve (not shown). With this compressor 15 it may be possible, for example, before the internal combustion engine 2 starts, to fill the compressed air vessel 14 with compressed air to such an extent that the stored compressed air has an assisting effect when the internal combustion engine 2 starts.

For example, this compressor 15 can also be representative of a compressed air generating system or an additional system which is present in a utility vehicle.

The valves can also be controlled pneumatically or electropneumatically.

The gas feed device 13 can be a fresh gas line section of the compressed air device described in German patent documents DE 10 2006 008 783 A1 and DE 10 2006 008 785 A1 and can be coupled to it.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

KEY TO REFERENCE SYMBOLS

1 Device
2 Internal combustion engine
3 Exhaust gas turbocharger
4 Exhaust gas turbine
5 Compressor
6 Coupling
7 Air inlet
8 Exhaust gas outlet
9 Intake line
10 Exhaust line
11 Air filter
12 Intake air pre-heating means
13 Gas feed device

14 Compressed air vessel
15 Compressor
16 Compressor drive
17 Compressor suction line
18 Compressor pressure line
19 Water separator
20 Suction line
21 Pressure line
22 Branching pressure line
23 Collecting pressure line
24 Blowing-in line
25 Pressure line valve
26 Branching line valve
27 Blowing-in valve
28 Control unit
I . . . VIII Cylinder

What is claimed is:

1. A method for generating compressed air and blowing the compressed air into an internal combustion engine having an exhaust gas turbocharger, comprising the acts of:

determining an operating state of the internal combustion engine from at least one operating parameter of the internal combustion engine;

generating compressed air by the internal combustion engine when it is determined that the operating state is an operating state without combustion in at least one cylinder of the internal combustion engine in which fuel is selectively supplied for combustion;

storing the generated compressed air; and blowing of the stored compressed air into the internal combustion engine when it is determined that the operating state is a combustion operating state of the internal combustion engine, wherein the compressed air is generated by the at least one cylinder of the internal combustion engine, the generated compressed air passes through an exhaust port of the at least one cylinder into an exhaust manifold of the internal combustion engine upstream of the exhaust gas turbocharger, the generated compressed air is routed from the exhaust manifold and stored in a compressed air vessel via at least one controlled valve between the at least one cylinder and the compressed air vessel, and the stored compressed air is blown into the internal combustion engine by controlled switching on of a blowing-in valve between the compressed air vessel and the internal combustion engine.

2. The method according to claim 1, wherein the compressed air is generated by at least one of the at least one cylinder of the internal combustion engine to which no fuel is fed in the operating state without combustion.

3. The method according to claim 2, wherein when the compressed air is generated in the operating state of the internal combustion engine without combustion, a cross section of an exhaust line is reduced by a throttle device.

4. An apparatus for generating compressed air and blowing the compressed air into internal combustion engine having an exhaust gas turbocharger, comprising:

at least one cylinder of the internal combustion engine to generate compressed air, the at least one cylinder being configured to combust fuel selectively supplied for combustion, wherein the internal combustion engine is configured to pass the compressed air through an exhaust port of the at least one cylinder into an exhaust manifold upstream of the exhaust gas turbocharger;

a compressed air vessel for storing the compressed air;

at least one valve arranged to connect an outlet of the exhaust manifold upstream of the exhaust gas turbocharger to the compressed air vessel when the internal combustion engine is in an operating state without combustion;

a blowing-in valve arranged to connect the compressed air vessel to an intake line of the internal combustion engine and to blow in stored compressed air when the internal combustion engine is in an operating state of acceleration; and a control unit for acquiring at least one operating parameter of the internal combustion engine, determining operating states of the internal combustion engine, and for controlling the at least one compressed air storage valve and the blowing in valve.

5. The apparatus according to claim 4, wherein an exhaust line of the internal combustion engine is configured to be connected via a branching valve to the compressed air vessel in the operating state of the internal combustion engine without combustion.

6. The apparatus according to claim 4, further comprising:

a water separator, the water separator dewater the compressed air associated with the compressed air vessel.

7. The apparatus according to claim 4, wherein the blowing-in valve is connected via a gas feed device arranged in the intake line.

8. The apparatus according to claim 7, wherein the gas feed device is a fresh gas line section of a device for supplying fresh air for the controlled blowing in of compressed air.

* * * * *